US009142334B2

(12) United States Patent
Muto et al.

(10) Patent No.: US 9,142,334 B2
(45) Date of Patent: Sep. 22, 2015

(54) FOAMED ELECTRICAL WIRE AND A METHOD OF PRODUCING THE SAME

(75) Inventors: Daisuke Muto, Tokyo (JP); Makoto Oya, Tokyo (JP); Yousuke Kokubo, Tokyo (JP); Akira Tanaka, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 308 days.

(21) Appl. No.: 13/610,289

(22) Filed: Sep. 11, 2012

(65) Prior Publication Data

US 2013/0014971 A1 Jan. 17, 2013

Related U.S. Application Data

(63) Continuation of application No. PCT/JP2011/057205, filed on Mar. 24, 2011.

(30) Foreign Application Priority Data

Mar. 25, 2010 (JP) ..... 2010-070068

(51) Int. Cl.

| | |
|---|---|
| ***H01B 7/00*** | (2006.01) |
| ***H01B 7/29*** | (2006.01) |
| ***H01B 3/30*** | (2006.01) |
| ***H01B 3/42*** | (2006.01) |
| *H01B 7/02* | (2006.01) |

(52) U.S. Cl.

CPC ..... *H01B 7/292* (2013.01); *H01B 3/301* (2013.01); *H01B 3/306* (2013.01); *H01B 3/421* (2013.01); *H01B 3/427* (2013.01); *H01B 7/0233* (2013.01)

(58) Field of Classification Search

CPC . H01B 3/00; H01B 3/30; H01B 3/301–3/308; H01B 3/36; H01B 3/38; H01B 3/42; H01B 3/421–3/442; H01B 7/00; H01B 7/0216; H01B 7/30

USPC ..... 174/110 R, 110 PM, 110 FC, 120 R, 174/120 SR, 121 SR

See application file for complete search history.

(56) References Cited

U.S. PATENT DOCUMENTS

| | | | | |
|---|---|---|---|---|
| 4,104,481 | A * | 8/1978 | Wilkenloh et al. | 174/28 |
| 4,473,665 | A * | 9/1984 | Martini-Vvedensky et al. | 521/79 |
| 4,711,811 | A * | 12/1987 | Randa | 428/383 |

(Continued)

FOREIGN PATENT DOCUMENTS

| | | | |
|---|---|---|---|
| CN | 1910224 | A | 2/2007 |
| JP | 61-148703 | A | 7/1986 |

(Continued)

OTHER PUBLICATIONS

Chinese Office Action dated Jan. 8, 2014 for Application No. 201180014961.2 with English translation thereof.

(Continued)

*Primary Examiner* — William H Mayo, III

(74) *Attorney, Agent, or Firm* — Birch, Stewart, Kolasch & Birch, LLP

(57) ABSTRACT

A foamed electrical wire, containing: a conductor; and a foamed insulating layer; in which the foamed insulating layer comprises a thermoplastic resin that is a crystalline thermoplastic resin having a melting point of 150° C. or more or a non-crystalline thermoplastic resin having a glass transition temperature of 150° C. or more, and the average bubble diameter of the foamed insulating layer is 5 μm or less.

14 Claims, 2 Drawing Sheets

(56) References Cited

U.S. PATENT DOCUMENTS

| | | | | | |
|---|---|---|---|---|---|
| 5,162,609 | A | * | 11/1992 | Adriaenssens et al. | 174/34 |
| 5,358,786 | A | * | 10/1994 | Ishikawa et al. | 428/380 |
| 5,563,377 | A | * | 10/1996 | Arpin et al. | 174/121 A |
| 5,841,072 | A | * | 11/1998 | Gagnon | 174/110 F |
| 5,841,073 | A | * | 11/1998 | Randa et al. | 174/113 R |
| 6,147,309 | A | * | 11/2000 | Mottine et al. | 174/110 PM |
| 7,795,539 | B2 | * | 9/2010 | Thuot et al. | 174/110 R |
| 2001/0000930 | A1 | * | 5/2001 | Kim | 264/1.24 |
| 2004/0241474 | A1 | * | 12/2004 | Domine | 428/500 |
| 2008/0087454 | A1 | | 4/2008 | Ohno et al. | |
| 2010/0144912 | A1 | * | 6/2010 | Kawasumi et al. | 521/80 |

FOREIGN PATENT DOCUMENTS

| | | | | | |
|---|---|---|---|---|---|
| JP | 3-275737 | | * | 12/1991 | C08J 9/14 |
| JP | 5-53044 | U | | 7/1993 | |
| JP | 06-155604 | A | * | 6/1994 | B29C 44/00 |
| JP | 2835472 | B2 | | 12/1998 | |
| JP | 3245209 | B2 | | 1/2002 | |
| JP | 3267228 | B2 | | 3/2002 | |
| JP | 3276665 | B2 | | 4/2002 | |
| JP | 3299552 | B2 | | 7/2002 | |
| JP | 3457543 | B2 | | 10/2003 | |
| JP | 2007-197650 | A | * | 8/2007 | C08J 9/12 |
| JP | 2007-242589 | A | | 9/2007 | |
| JP | 2008-019379 | A | | 1/2008 | |
| JP | 2008-21585 | A | | 1/2008 | |
| JP | 2009-59690 | A | | 3/2009 | |

OTHER PUBLICATIONS

Internation Search Report issued in PCT/JP2011/057205 mailed on Jun. 28, 2011.

* cited by examiner

FOAMED ELECTRICAL WIRE AND A METHOD OF PRODUCING THE SAME

This application is a Continuation of PCT International Application No. PCT/JP2011/057205 filed on Mar. 24, 2011, which claims priority under 35 U.S.C 119(a) to Application No. 2010-070068 filed in Japan on Mar. 25, 2010, all of which are hereby expressly incorporated by reference into the present application.

TECHNICAL FIELD

The present invention relates to a foamed electrical wire and a method of producing the same.

BACKGROUND ART

Inverters have been employed in many types of electrical equipments, as an efficient variable-speed control unit. Inverters are switched at a frequency of several kHz to tens of kHz, to cause a surge voltage at every pulse thereof. Inverter surge is a phenomenon in which reflection occurs at a break-point of impedance, for example, at a starting end, a termination end, or the like of a connected wire in the propagation system, followed by applying a voltage twice as high as the inverter output voltage at the maximum. In particular, an output pulse occurred due to a high-speed switching device, such as an IGBT, is high in steep voltage rise. Accordingly, even if a connection cable is short, the surge voltage is high, and voltage decay due to the connection cable is also low. As a result, a voltage almost twice as high as the inverter output voltage occurs.

As coils for electrical equipments, such as inverter-related equipments, for example, high-speed switching devices, inverter motors, and transformers, insulated wires made of enameled wires are mainly used as magnet wires in the coils. Further, as described above, since a voltage almost twice as high as the inverter output voltage is applied in inverter-related equipments, it is required in insulated wires to have minimized partial discharge deterioration, which is attributable to inverter surge.

In general, partial discharge deterioration is a phenomenon in which an electrical insulating material undergoes, in a complicated manner, for example, molecular chain breakage deterioration caused by collision with charged particles that have been generated by partial discharge of the electrical insulating material, sputtering deterioration, thermal fusion or thermal decomposition deterioration caused by local temperature rise, and chemical deterioration caused by ozone generated due to discharge. For this reason, reduction in thickness, for example, is observed in the actual electrical-insulation materials, which have been deteriorated as a result of partial discharge.

In order to obtain an insulated wire in which no partial discharge is caused, i.e., an insulated wire having a high partial discharge inception voltage so as to prevent an insulated wire from the deterioration caused by such a partial discharge, such measures are studied as increasing the thickness of an insulating layer of the insulated wire, or using a resin having a low dielectric constant in the insulating layer.

However, when the thickness of the insulating layer is increased, the resultant insulated wire becomes thicker, and as a result, size enlargement of electrical equipments is brought about. This is retrograde to the demand in recent miniaturization of electrical equipments represented by motors and transformers. For example, specifically, it is no exaggeration to say that the performance of a rotator, such as a motor, is determined by how many electrical wires are held in a cross section of a stator slot. As a result, the ratio (space factor) of the sectional area of conductors to the sectional area of the stator slot, has been highly increased in recent years. Thus, if the thickness of the insulating layer is increased, the space factor is lowered, which is not preferable.

On the other hand, with respect to the dielectric constant of an insulating layer, most of resins that are generally used as a material for the insulating layer have a dielectric constant from 3 to 4, and thus there is no resin having a specifically low dielectric constant. Furthermore, in practice, a resin having a low dielectric constant cannot always be selected when other properties that are required for the insulating layer (heat resistance, solvent resistance, flexibility and the like) are taken into consideration.

As a means for decreasing the substantial dielectric constant of the insulating layer, such a measure is studied as foaming the insulating layer, and foamed electrical wires containing a conductor and a foamed insulating layer have been widely used as communication lines. Conventionally, foamed electrical wires such as those obtained by foaming an olefin-based resin such as polyethylene or a fluorine resin have been well-known. As examples of such foamed wires, foamed polyethylene insulating electrical wires are described in Patent Literatures 1 and 2, foamed fluorine resin insulating electrical wires are described in Patent Literatures 3 and 4, the both insulating electrical wires are described in Patent Literature 5, and a foamed polyolefin insulating electrical wire is described in Patent Literature 6. However, in such conventional foamed electrical wires, the dielectric breakdown voltage is decreased as the foaming magnification is increased.

CITATION LIST

Patent Literatures

Patent Literature 1: Japanese Patent No. 2835472
Patent Literature 2: Japanese Patent No. 3299552
Patent Literature 3: Japanese Patent No. 3276665
Patent Literature 4: Japanese Patent No. 3245209
Patent Literature 5: Japanese Patent No. 3457543
Patent Literature 6: Japanese Patent No. 3267228

SUMMARY OF INVENTION

Technical Problem

The present invention has been made so as to solve the above-mentioned problems. The present invention is contemplated for providing a foamed electrical wire excellent in dielectric breakdown voltage even the foaming magnification is increased, and also excellent in partial discharge property by a low dielectric constant property due to foaming; and a method of producing the same.

Solution to Problem

The foamed electrical wire of the present invention contains a conductor and a foamed insulating layer, and the foamed insulating layer contains a thermoplastic resin that is a crystalline thermoplastic resin having a melting point of 150° C. or more or a non-crystalline thermoplastic resin having a glass transition temperature of 150° C. or more, and the average bubble diameter of the foamed insulating layer is 5 μm or less.

As used herein, "crystalline" refers to a state that a polymer is arranged with regularity. To the contrary, "non-crystalline" refers to that a polymer is, for example, in a yarn ball-like or entangled amorphous state.

Advantageous Effects of Invention

The foamed electrical wire of the present invention is excellent in dielectric breakdown voltage even the foaming magnification is increased, and also excellent in partial discharge resistance by a low dielectric constant property due to foaming.

Specifically, the foamed electrical wire of the present invention containing a foamed insulating layer composed of a thermoplastic resin that is a crystalline thermoplastic resin having a melting point of 150° C. or more or a non-crystalline thermoplastic resin having a glass transition temperature of 150° C. or more, in which the average bubble diameter of the foamed insulating layer is 5 μm or less, can provide an effect that the dielectric breakdown voltage is not decreased. Although the upper limit value of the melting point of the above-mentioned crystalline thermoplastic resin or the glass transition temperature of the non-crystalline thermoplastic resin is not specifically limited, it is generally 400° C. or less. Although the lower limit value of the average bubble diameter of the above-mentioned foamed insulating layer is not specifically limited, it is generally 0.01 μm or more.

Furthermore, by using a foamed insulating layer having an effective dielectric constant of 2.5 or less, more preferably 2.0 or less, or by using a thermoplastic resin having a dielectric constant of 4.0 or less, more preferably 3.5 or less, an effect of remarkably improving a partial discharge inception voltage can be obtained. The foamed electrical wire of the present invention containing a foamed insulating layer composed of a crystalline thermoplastic resin can provide an effect that the solvent resistance and chemical resistance become fine. The lower limit value of the effective dielectric constant of the above-mentioned foamed insulating layer is not specifically limited and is generally 1.1 or more. The lower limit value of the dielectric constant of the above-mentioned thermoplastic resin is not specifically limited and is generally 2.0 or more.

Furthermore, an effect that mechanical properties such as wearing resistance and tensile strength can be retained finely could be obtained by providing a non-foamed outer skin layer to the outside of the above-mentioned foamed insulating layer, providing a non-foamed inner skin layer inside of the above-mentioned foamed insulating layer, or providing the both of these skin layers. The skin layers may be those formed during a foaming step. The inner skin layer can be formed by foaming before gas is saturated. In this case, the number of bubbles can be inclined in the thickness direction of the foamed insulating layer. Alternatively, the inner skin layer can be disposed by a method such as multilayer extrusion coating. In this case, the inner skin layer can be formed by coating the inside in advance with a resin that is difficult to be foamed.

According to the method of producing a foamed electrical wire of the present invention, it is possible to produce these foamed electrical wires.

Other and further features and advantages of the invention will appear more fully from the following description, appropriately referring to the accompanying drawings.

MODE FOR CARRYING OUT THE INVENTION

The foamed electrical wire of the present invention will be explained, with reference to the drawings.

Figure 1A:
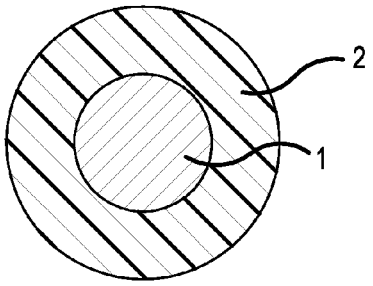
FIG. 1(*a*) is a cross-sectional view showing an embodiment of the foamed electrical wire of the present invention, and FIG. 1(*b*) is a cross-sectional view showing another embodiment of the foamed electrical wire of the present invention.
Figure 1B:
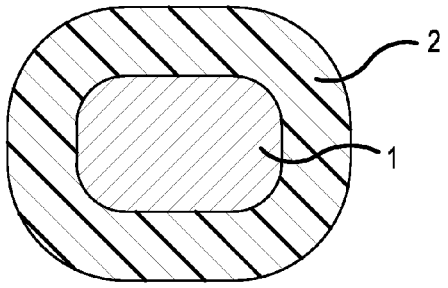
Figure 2A:
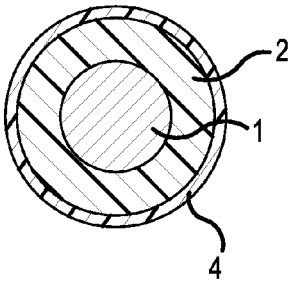
FIG. 2(*a*) is a cross-sectional view showing further another embodiment of the foamed electrical wire of the present invention, FIG. 2(*b*) is a cross-sectional view showing further another embodiment of the foamed electrical wire of the present invention, and FIG. 2(*c*) is a cross-sectional view showing still another embodiment of the foamed electrical wire of the present invention.
Figure 2B:
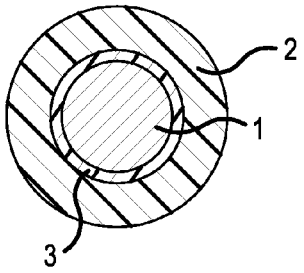
Figure 2C:
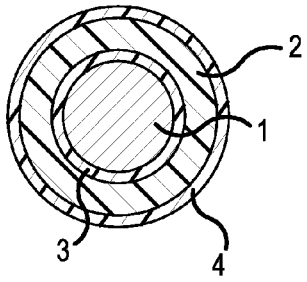

An embodiment of the foamed electrical wire of the present invention, as shown in the cross-sectional view in FIG. 1(*a*), has a conductor 1, and a foamed insulating layer 2 covering the conductor 1. In another embodiment of the foamed electrical wire of the present invention for which a cross-sectional view is shown in FIG. 1 (*b*), the cross-sectional surface of the conductor has a rectangular shape. A still another embodiment of the foamed electrical wire of the present invention, as shown in the cross-sectional view in FIG. 2(*a*), has an outer skin layer 4 on the periphery of a foamed insulating layer 2. A still another embodiment of the foamed electrical wire of the present invention, as shown in FIG. 2(*b*), has an inner skin layer 3 inside of a foamed insulating layer 2. A yet still another embodiment of the foamed electrical wire of the present invention, as shown in the cross-sectional view in FIG. 2(*c*), has an outer skin layer 4 on the periphery of a foamed insulating layer 2 and an inner skin layer 3 inside of the foamed insulating layer 2.

The conductor 1 is made of, for example, copper, a copper alloy, aluminum, an aluminum alloy, or a combination thereof. The cross-sectional shape of the conductor 1 is not limited, and a circular shape, a rectangular shape (perpendicular shape), and the like can be applied.

The foamed insulating layer 2 has an average bubble diameter of 5 μm or less, preferably 1 μm or less. Since the dielectric breakdown voltage is decreased when the average bubble diameter exceeds 5 μm, the dielectric breakdown voltage can be maintained finely by adjusting the average bubble diameter to 5 μm or less. Furthermore, the dielectric breakdown voltage can be retained more certainly by adjusting the average bubble diameter to 1 μm or less. Although the lower limit of the average bubble diameter is not limited, it is practical and preferable that the lower limit is 1 nm or more. Although the thickness of the foamed resin layer 2 is not limited, it is practical and preferable that the thickness is from 30 to 200 μm.

As the thermoplastic resin of the foamed insulating layer 2, any of one having heat-resistant thermoplastic resins is preferable. For example, use may be made of any of polyphenylenesulfides (PPS), polyethyleneterephthalate (PET), polyethylenenaphthalate (PEN), polybutyleneterephthalate (PBT), polyether ether ketones (PEEK), polycarbonates (PC), polyethersulfones (PES), polyetherimides (PEI), and thermoplastic polyimides (PI). In the present specification, "having heat resistance" means that the melting point of the crystalline thermoplastic resin or the glass transition temperature of the non-crystalline thermoplastic resin is 150° C. or more. As used herein, the melting point refers to a value determined by a differential scanning calorimetry using a differential scanning calorimeter (DSC). The glass transition temperature refers to a value determined by using a differential scanning calorimeter (DSC). In the present invention, the crystalline thermoplastic resin is more preferable. Examples thereof include polyphenylene sulfide (PPS), polyethylene telephthalate (PET), polyethylene naphthalate (PEN), polybutylene telephthalate (PBT), and polyether ether ketone (PEEK).

By using a crystalline thermoplastic resin, a foamed electrical wire excellent in solvent resistance and excellent chemical resistance can be obtained. Furthermore, by using a crystalline thermoplastic resin, the skin layer can be thinned and the obtained foamed electrical wire has a fine low dielectric property. In the present specification, the skin layer means a non-foamed layer.

Furthermore, it is preferable to use a thermoplastic resin having a dielectric constant of 4.0 or less, more preferably 3.5 or less.

The reason is that the effective dielectric constant of the foamed insulating layer is preferably 2.5 or less, further preferably 2.0 or less, so as to obtain an effect of improving a partial discharge inception voltage in the obtained foamed electrical wire and such a foamed electrical wire is obtained easily by using a thermoplastic resin having the above-mentioned dielectric constant.

The dielectric constant can be determined by using a commercially available determination apparatus. Although the determination temperature and the determination frequency can be changed as necessary, the determination is conducted at 25° C. and 50 Hz in this specification unless otherwise indicated.

The thermoplastic resin may be used singly, or as a mixture of two or more of the same.

According to the present invention, various additives such as a crystallization nucleating agent, a crystallization accelerating agent, a foam nucleating agent, an oxidation inhibitor, an antistatic agent, an anti-ultraviolet agent, a light stabilizer, a fluorescent brightening agent, a pigment, a dye, a compatibilizing agent, a lubricating agent, a reinforcing agent, a flame retardant, a crosslinking agent, a crosslinking aid, a plasticizer, a thickening agent, a thinning agent, and an elastomer may be incorporated into the raw materials for forming the foamed insulating layer, to the extent that the characteristics are not affected. Furthermore, a layer formed from a resin containing these additives may be laminated on the resulting foamed electrical wire, or the insulated wire may be coated with a coating material containing these additives.

Furthermore, it is preferable that the foamed electrical wire contains a non-foamed outer skin layer outside of the foamed insulating layer, a non-foamed inner skin layer inside of the foamed insulating layer, or the both skin layers. However, in this case, the total of the thickness of the inner skin layer and the thickness of the outer skin layer is preferably 20% or less, more preferably 10% or less with respect to the total of the thickness of the inner skin layer, the thickness of the outer skin layer and the thickness of the foamed insulating layer, so that an effect of decreasing the dielectric constant is not inhibited. The lower limit value of the ratio of the total of the thickness of the inner skin layer and the thickness of the outer skin layer with respect to the total of the thickness of the inner skin layer, the thickness of the outer skin layer and the thickness of the foamed insulating layer is not specifically limited and is generally 1% or more. By providing the inner skin layer or outer skin layer, the smoothness of the surface is improved and thus the insulation property is improved. Furthermore, mechanical strengths such as wearing resistance and tensile strength can be retained.

The foaming magnification is preferably 1.2 times or more, and more preferably 1.4 times or more. By satisfying this, the specific dielectric constant necessary to obtain an effect to improve the partial discharge inception voltage can be realized. The upper limit of the foaming magnification is not limited, but is preferably 5.0 times or less.

The foaming magnification is obtained by determining the density of a resin coated for foaming ($\rho f$) and the density of the resin before foaming ($\rho s$) by the underwater replacement method, and calculating the foaming magnification from ($\rho s/\rho f$).

In the foamed electrical wire of the present invention, the method for foaming the thermoplastic resin is not specifically limited, and may be conducted by incorporating a foaming agent during extrusion molding, providing a coating by foaming extrusion by filling nitrogen gas or carbon dioxide gas, or filling gas after extrusion molding into an electrical wire.

The method of foaming by filling gas after extrusion molding into an electrical wire will be explained in more detail. This method contains steps of: providing a coating of a resin around a conductor by extrusion using an extrusion die; retaining the resin in a pressurized inert gas atmosphere to incorporate inert gas into the resin; and foaming the resin by heating under an ordinary pressure.

In this case, it is preferable to produce it, for example, as follows, with consideration for quantity production. Namely, the thermoplastic resin is molded into an electrical wire, and the electrical wire is then superposed alternately with separators and wound around a bobbin to form a roll, the obtained roll is retained in a pressurized inert gas atmosphere to incorporate the inert gas into the roll, and the roll is further heated to the softening temperature or more of the thermoplastic resin that is the raw material of the coating material under an ordinary pressure to foam the resin. The separators used at this time are not specifically limited, and a nonwoven fabric that allows passage of gas can be used. The size is adjusted to the width of the bobbin and can be suitably adjusted as necessary.

Alternatively, the thermoplastic resin can be foamed continuously by incorporating inert gas into an electrical wire, then disposing the electrical wire in a feeding machine, and passing the electrical wire through a hot air furnace that is installed between the feeding machine and a winding machine, in which the electrical wire is heated to a temperature equal to or higher than the softening temperature of the thermoplastic resin under an ordinary pressure.

Examples of the inert gas include helium, nitrogen, carbon dioxide, and argon. The penetration time period of the inert gas and the penetration amount of the inert gas to reach the saturation state of the bubbles, can be different, in accordance with the kind of the thermoplastic resin in which bubbles are foamed, the kind of the inert gas, the pressure for penetration, and the thickness of the foamed insulating layer. The inert gas is more preferably carbon dioxide with consideration for the velocity and solubility which represent the permeability of the gas into the thermoplastic resin.

EXAMPLES

The present invention will be described in more detail based on examples given below, but the invention is not meant to be limited by these.

The present inventors have carried out by using a PEN resin for determining the dielectric breakdown voltages, the effective dielectric constant and the partial discharge inception voltage (PDIV) in the cases where the average bubble diameter was from 0.1 to 5 μm (Examples 1 to 8), the cases where the bubble diameter was from 7 to 31 μm (Comparative Examples 1 to 6) and the cases where the resin was not foamed (Comparative Examples 7 and 8).

Example 1

An extruded coating layer composed of the PEN resin with a thickness of 100 μm was formed on the periphery of a copper wire with a diameter of 1 mm, and the copper wire was put into a pressure container and subjected to a pressurization treatment at −25° C. and 1.7 MPa for 168 hours, thereby carbon dioxide gas was penetrated into the coating layer until saturation. Next, the copper wire was taken out from the pressure container and put into a hot air circulation-type foaming furnace that had been set to 100° C. for 1 minute to foam the coating layer, to give a foamed electrical wire of Example 1. A cross-sectional view of the obtained foamed electrical wire is shown in FIG. 2(*a*). With respect to the obtained foamed electrical wire of Example 1, measurements were conducted by the methods mentioned below. The results are shown in Table 1-1.

Example 2

The foamed electrical wire of Example 2 was obtained in a similar manner to that in Example 1, except that the pressurization treatment was carried out in a carbon dioxide gas atmosphere at 0° C. and 3.6 MPa for 240 hours and a copper wire having an extruded coating layer was put into a hot air circulation-type foaming furnace that had been set to 120° C. A cross-sectional view of the obtained foamed electrical wire is shown in FIG. 2(*a*). With respect to the obtained foamed electrical wire of Example 2, similar measurements to those in Example 1 were conducted. The results are shown in Table 1-1.

Example 3

The foamed electrical wire of Example 3 was obtained in a similar manner to that in Example 1, except that the pressurization treatment was carried out in a carbon dioxide gas atmosphere at −30° C. and 1.3 MPa for 456 hours and a copper wire having an extruded coating layer was put into a hot air circulation-type foaming furnace that had been set to 120° C. for 1 minute. A cross-sectional view of the obtained foamed electrical wire is shown in FIG. 2(*a*). With respect to the obtained foamed electrical wire of Example 3, similar measurements to those in Example 1 were conducted. The results are shown in Table 1-1.

Example 4

The foamed electrical wire of Example 4 was obtained in a similar manner to that in Example 1, except that the pressurization treatment was carried out in a carbon dioxide gas atmosphere at 0° C. and 3.6 MPa for 240 hours and a copper wire having an extruded coating layer was put into a hot air circulation-type foaming furnace that had been set to 100° C. for 1 minute. A cross-sectional view of the obtained foamed electrical wire is shown in FIG. 2(*a*). With respect to the obtained foamed electrical wire of Example 4, similar measurements to those in Example 1 were conducted. The results are shown in Table 1-1.

Example 5

The foamed electrical wire of Example 5 was obtained in a similar manner to that in Example 1, except that the pressurization treatment was carried out in a carbon dioxide gas atmosphere at 0° C. and 3.6 MPa for 96 hours and a copper wire having an extruded coating layer was put into a hot air circulation-type foaming furnace that had been set to 120° C. for 1 minute. A cross-sectional view of the obtained foamed electrical wire is shown in FIG. 2(*a*). With respect to the obtained foamed electrical wire of Example 5, similar measurements to those in Example 1 were conducted. The results are shown in Table 1-1.

Example 6

The foamed electrical wire of Example 6 was obtained in a similar manner to that in Example 1, except that the pressurization treatment was carried out in a carbon dioxide gas atmosphere at 0° C. and 3.6 MPa for 96 hours and a copper wire having an extruded coating layer was put into a hot air circulation-type foaming furnace that had been set to 140° C. for 1 minute. A cross-sectional view of the obtained foamed electrical wire is shown in FIG. 2(*a*). With respect to the obtained foamed electrical wire of Example 6, similar measurements to those in Example 1 were conducted. The results are shown in Table 1-1.

Example 7

The foamed electrical wire of Example 7 was obtained in a similar manner to that in Example 1, except that the pressurization treatment was carried out in a carbon dioxide gas atmosphere at 0° C. and 3.6 MPa for 96 hours and a copper wire having an extruded coating layer was put into a hot air circulation-type foaming furnace that had been set to 140° C. for 1 minute. A cross-sectional view of the obtained foamed electrical wire is shown in FIG. 2(*a*). With respect to the obtained foamed electrical wire of Example 7, similar measurements to those in Example 1 were conducted. The results are shown in Table 1-1.

Example 8

The foamed electrical wire of Example 8 was obtained in a similar manner to that in Example 1, except that the pressurization treatment was carried out in a carbon dioxide gas atmosphere at 17° C. and 4.7 MPa for 16 hours and a copper wire having an extruded coating layer was put into a hot air circulation-type foaming furnace that had been set to 90° C. for 1 minute. A cross-sectional view of the obtained foamed electrical wire is shown in FIG. 2(*a*). With respect to the obtained foamed electrical wire of Example 8, similar measurements to those in Example 1 were conducted. The results are shown in Table 1-1.

Comparative Example 1

The foamed electrical wire of Comparative Example 1 was obtained in a similar manner to that in Example 1, except that the pressurization treatment was carried out in a carbon dioxide gas atmosphere at 17° C. and 5.0 MPa for 16 hours and a copper wire having an extruded coating layer was put into a hot air circulation-type foaming furnace that had been set to 100° C. for 1 minute. With respect to the obtained foamed electrical wire of Comparative Example 1, similar measurements to those in Example 1 were conducted. The results are shown in Table 1-2.

Comparative Example 2

The foamed electrical wire of Comparative Example 2 was obtained in a similar manner to that in Example 1, except that the pressurization treatment was carried out in a carbon dioxide gas atmosphere at 17° C. and 4.7 MPa for 16 hours and a copper wire having an extruded coating layer was put into a hot air circulation-type foaming furnace that had been set to 120° C. for 1 minute. With respect to the obtained foamed electrical wire of Comparative Example 2, similar measurements to those in Example 1 were conducted. The results are shown in Table 1-2.

Comparative Example 3

The foamed electrical wire of Comparative Example 3 was obtained in a similar manner to that in Example 1, except that the pressurization treatment was carried out in a carbon dioxide gas atmosphere at 17° C. and 5.0 MPa for 24 hours and a copper wire having an extruded coating layer was put into a hot air circulation-type foaming furnace that had been set to 140° C. for 1 minute. With respect to the obtained foamed electrical wire of Comparative Example 3, similar measurements to those in Example 1 were conducted. The results are shown in Table 1-2.

Comparative Example 4

The foamed electrical wire of Comparative Example 4 was obtained in a similar manner to that in Example 1, except that the pressurization treatment was carried out in a carbon dioxide gas atmosphere at 17° C. and 4.8 MPa for 3 hours and a copper wire having an extruded coating layer was put into a hot air circulation-type foaming furnace that had been set to 140° C. for 1 minute. With respect to the obtained foamed electrical wire of Comparative Example 4, similar measurements to those in Example 1 were conducted. The results are shown in Table 1-2.

Comparative Example 5

The foamed electrical wire of Comparative Example 5 was obtained in a similar manner to that in Example 1, except that the pressurization treatment was carried out in a carbon dioxide gas atmosphere at 50° C. and 4.9 MPa for 7 hours and a copper wire having an extruded coating layer was put into a hot air circulation-type foaming furnace that had been set to 140° C. for 1 minute. With respect to the obtained foamed electrical wire of Comparative Example 5, similar measurements to those in Example 1 were conducted. The results are shown in Table 1-2.

Comparative Example 6

The foamed electrical wire of Comparative Example 6 was obtained in a similar manner to that in Example 1, except that the pressurization treatment was carried out in a carbon dioxide gas atmosphere at 50° C. and 4.9 MPa for 3 hours and a copper wire having an extruded coating layer was put into a hot air circulation-type foaming furnace that had been set to 140° C. for 1 minute. With respect to the obtained foamed electrical wire of Comparative Example 6, similar measurements to those in Example 1 were conducted. The results are shown in Table 1-2.

Comparative Example 7

An extruded coating layer composed of the PEN resin with a thickness of 100 μm was formed on the periphery of a copper wire with a diameter of 1 mm, to give an electrical wire of Comparative Example 7. With respect to the obtained electrical wire of Comparative Example 7, similar measurements to those in Example 1 were conducted. The results are shown in Table 1-2.

Comparative Example 8

An extruded coating layer composed of the PEN resin with a thickness of 0.14 μm was formed on the periphery of a copper wire with a diameter of 1 mm, to give an electrical wire of Comparative Example 8. With respect to the obtained electrical wire of Comparative Example 8, similar measurements to those in Example 1 were conducted. The results are shown in Table 1-2.

Example 9

An extruded coating layer composed of a PPS resin with a thickness of 30 μm was formed on the periphery of a copper wire with a diameter of 1 mm, and the copper wire was put into a pressure container and subjected to a pressurization treatment at −32° C. and 1.2 MPa for 24 hours, thereby carbon dioxide gas was penetrated into the coating layer until saturation. Next, the copper wire was taken out from the pressure container and put into a hot air circulation-type foaming furnace that had been set to 200° C. for 1 minute to foam the coating layer, to give a foamed electrical wire of Example 9. A cross-sectional view of the obtained foamed electrical wire is shown in FIG. 2(*c*). The PPS resin used contained suitable amounts of an elastomer component and additives. With respect to the obtained foamed electrical wire of Example 9, measurements were conducted by the methods mentioned below. The results are shown in Table 2.

Example 10

An extruded coating layer composed of a PPS resin with a thickness of 40 μm was formed on the periphery of a copper wire with a diameter of 0.4 mm, and the copper wire was put into a pressure container and subjected to a pressurization treatment at −32° C. and 1.2 MPa for 55 hours, thereby carbon dioxide gas was penetrated into the coating layer until saturation. Next, the copper wire was taken out from the pressure container and put into a hot air circulation-type foaming furnace that had been set to 200° C. for 1 minute, to foam the coating layer; and then coated with an outer skin layer with the thickness shown in Table 1-1, to give a foamed electrical wire of Example 10. A cross-sectional view of the obtained foamed electrical wire is shown in FIG. 2(*c*). The PPS resin used contained suitable amounts of an elastomer component and additives. With respect to the obtained foamed electrical wire of Example 10, measurements were conducted by the methods mentioned below. The results are shown in Table 2.

Example 11

An extruded coating layer composed of a PPS resin with a thickness of 40 μm was formed on the periphery of a copper wire with a diameter of 0.4 mm, and the copper wire was put into a pressure container and subjected to a pressurization treatment at 17° C. and 4.9 MPa for 55 hours, thereby carbon dioxide gas was penetrated into the coating layer until saturation. Next, the copper wire was taken out from the pressure container and put into a hot air circulation-type foaming furnace that had been set to 120° C. for 1 minute to foam the coating layer, to give a foamed electrical wire of Example 11. A cross-sectional view of the obtained foamed electrical wire is shown in FIG. 2(*c*). The PPS resin used contained suitable amounts of an elastomer component and additives. With respect to the obtained foamed electrical wire of Example 11, measurements were conducted by the methods mentioned below. The results are shown in Table 2.

Comparative Example 9

An extruded coating layer composed of a PPS resin with a thickness of 40 μm was formed on the periphery of a copper wire with a diameter of 1 mm, and the copper wire was put into a pressure container and subjected to a pressurization treatment at 35° C. and 5.4 MPa for 24 hours, thereby carbon dioxide gas was penetrated into the coating layer until saturation. Next, the copper wire was taken out from the pressure container and put into a hot air circulation-type foaming furnace that had been set to 220° C. for 1 minute to foam the coating layer, to give a foamed electrical wire of Comparative Example 9. The PPS resin used contained suitable amounts of an elastomer component and additives. With respect to the obtained foamed electrical wire of Comparative Example 9, measurements were conducted by the methods mentioned below. The results are shown in Table 2.

Comparative Example 10

An extruded coating layer composed of a PPS resin with a thickness of 30 μm was formed on the periphery of a copper wire with a diameter of 1 mm, to give an electrical wire of Comparative Example 10. The PPS resin used contained suitable amounts of an elastomer component and additives. With respect to the obtained electrical wire of Comparative Example 10, similar measurements to those in Example 1 were conducted. The results are shown in Table 2.

Comparative Example 11

An extruded coating layer composed of a PPS resin with a thickness of 40 μm was formed on the periphery of a copper wire with a diameter of 0.4 mm, to give an electrical wire of Comparative Example 11. The PPS resin used contained suitable amounts of an elastomer component and additives. With respect to the obtained electrical wire of Comparative Example 11, similar measurements to those in Example 1 were conducted. The results are shown in Table 2.

Example 12

An extruded coating layer composed of a PET resin with a thickness of 32 μm was formed on the periphery of a copper wire with a diameter of 0.5 mm, and the copper wire was put into a pressure container and subjected to a pressurization treatment at −30° C. and 1.7 MPa for 42 hours, thereby carbon dioxide gas was penetrated into the coating layer until saturation. Next, the copper wire was taken out from the pressure container and put into a hot air circulation-type foaming furnace that had been set to 200° C. for 1 minute to foam the coating layer, to give a foamed electrical wire of Example 12. A cross-sectional view of the obtained foamed electrical wire is shown in FIG. 2(*a*). The PET resin used contained a suitable amount of an elastomer component. With respect to the obtained foamed electrical wire of Example 12, measurements were conducted by the methods mentioned below. The results are shown in Table 3.

Comparative Example 12

An extruded coating layer composed of a PET resin with a thickness of 32 μm was formed on the periphery of a copper wire with a diameter of 0.5 mm, and the copper wire was put into a pressure container and subjected to a pressurization treatment at 17° C. and 5.0 MPa for 42 hours, thereby carbon dioxide gas was penetrated into the coating layer until saturation. Next, the copper wire was taken out from the pressure container and put into a hot air circulation-type foaming furnace that had been set to 200° C. for 1 minute to foam the coating layer, to give a foamed electrical wire of Comparative Example 12. The PET resin used contained a suitable amount of an elastomer component. With respect to the obtained foamed electrical wire of Comparative Example 12, measurements were conducted by the methods mentioned below. The results are shown in Table 3.

Comparative Example 13

An extruded coating layer composed of a PET resin with a thickness of 32 μm was formed on the periphery of a copper wire with a diameter of 0.5 mm, to give an electrical wire of Comparative Example 13. The PET resin used contained a suitable amount of an elastomer. With respect to the obtained electrical wire of Comparative Example 13, similar measurements to those in Example 1 were conducted. The results are shown in Table 3.

The methods for evaluation are as follows.

[Thickness of Foamed Insulating Layer and Average Bubble Diameter]

The thickness and average bubble diameter of the foamed insulating layer were determined by observing the cross-sectional surface of the foamed electrical wire with a scanning electron microscope (SEM). The average bubble diameter is explained in more detail. The diameters of 20 bubbles that were arbitrarily selected from the cross-sectional surface observed with the SEM were determined and the average value thereof was obtained.

[Foaming Magnification]

The density of a foamed electrical wire (ρf) and the density of the wire before foaming (ρs) were determined by the underwater replacement method, and a foaming magnification was calculated from a ratio (ρf/ρs).

[Effective Dielectric Constant]

For the effective dielectric constant, the electrostatic capacity of the resultant respective foamed electrical wire was determined, to give the dielectric constant obtained from the electrostatic capacity and the thickness of the foamed insulating layer. For the determination of the electrostatic capacity, LCR HITESTER (manufactured by Hioki E.E. Corp., Model 3532-50) was used.

[Dielectric Breakdown Voltage]

Among the aluminum foil method shown below and the twist-pair method, the aluminum foil method was selected.

(Aluminum Foil Method)

The electrical wire was cut out in the appropriate length, and an aluminum foil with 10-mm width was wound around on the vicinity of the central portion of the wire; then, an alternating voltage of 50-Hz sinusoidal wave was applied between the aluminum foil and the conductor, to determine the voltage (effective value) causing dielectric breakdown while continuously raising the voltage. The determination temperature was set at ambient temperature.

(Twisted Pair Method)

Two of any of the electrical wires were twisted together, and an alternating current voltage with sine wave at frequency 50 Hz was applied between the conductors. While the voltage was continuously increased, the voltage (effective value) at which the dielectric voltage occurred, was determined. The determination temperature was set at ambient temperature.

[Partial Discharge Inception Voltage]

Specimens were prepared by combining two electrical wires into a twisted form, an alternating voltage with sine wave 50 Hz was applied between the respective two conductors twisted, and while the voltage was continuously raised, the voltage (effective value) at which the amount of discharged charge was 10 pC was determined. The determination temperature was set at the ambient temperature. For the determination of the partial discharge inception voltage, a partial discharge tester (KPD2050, manufactured by Kikusui Electronics Corp.) was used.

[Melting Point and Glass Transition Temperature]

The melting point was determined by Differential Scanning calorimetry (DSC). The glass transition temperature was determined by DSC.

Figure 3:
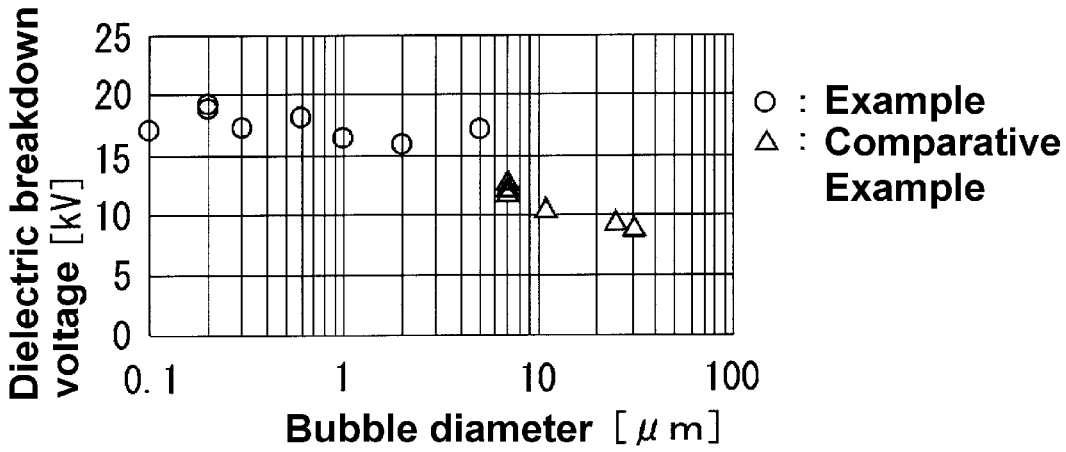
FIG. 3 is a graph showing the dielectric breakdown voltages of the foamed electrical wires against the bubble diameters in Examples 1 to 8 and Comparative Examples 1 to 6.

The evaluation results of the foamed electrical wires obtained in Examples 1 to 12 and Comparative Examples 1 to 13 are shown in Tables 1-1, 1-2 and 3. FIG. 3 shows the dielectric breakdown voltages of the foamed electrical wires against the bubble diameters in Examples 1 to 8 and Comparative Examples 1 to 6 by a graph. The results of Examples 1 to 8 are shown by "○", and the results of Comparative Examples 1 to 6 are shown by "Δ".

TABLE 1-1

| | Ex 1 | Ex 2 | Ex 3 | Ex 4 | Ex 5 | Ex 6 | Ex 7 | Ex 8 |
|---|---|---|---|---|---|---|---|---|
| Material of insulating layer | PEN | PEN | PEN | PEN | PEN | PEN | PEN | PEN |
| Melting point [° C.] | 265 | 265 | 265 | 265 | 265 | 265 | 265 | 265 |
| Glass transition temperature [° C.] | 155 | 155 | 155 | 155 | 155 | 155 | 155 | 155 |
| Dielectric constant of thermoplastic resin | 3.0 | 3.0 | 3.0 | 3.0 | 3.0 | 3.0 | 3.0 | 3.0 |
| Average bubble diameter [μm] | 0.1 | 0.2 | 0.2 | 0.3 | 0.6 | 1 | 2 | 5 |
| Foaming magnification | 2.1 | 2.6 | 3.0 | 2.0 | 3.2 | 2.8 | 2.8 | 1.4 |
| Thickness of foamed insulating layer [μm] | 145 | 143 | 142 | 145 | 151 | 150 | 145 | 132 |
| Thickness of outer skin layer [μm] | 6 | 4 | 5 | 5 | 2 | 3 | 3 | 9 |
| Thickness of inner skin layer [μm] | ≤1 | ≤1 | ≤1 | ≤1 | ≤1 | ≤1 | ≤1 | ≤1 |
| (Total thickness of inner and outer skin layers)/ (Total thickness of inner and outer skin layers and foamed insulating layer) [%] | 4.0-4.6 | 2.7-3.4 | 3.4-4.1 | 3.3-4.0 | 1.3-1.9 | 2.0-2.6 | 2.0-2.7 | 6.4-7.0 |
| Dielectric breakdown voltage [kV] | 17.0 | 19.2 | 18.9 | 17.3 | 18.1 | 16.3 | 15.8 | 17.1 |
| Effective dielectric constant of foamed insulating layer | 1.9 | 1.7 | 1.6 | 1.9 | 1.6 | 1.7 | 1.7 | 2.4 |
| Partial discharge inception voltage [V] | 1650 | 1700 | 1750 | 1650 | 1800 | 1750 | 1700 | 1450 |

"Ex" means Example according to the present invention.

TABLE 1-2

| | C Ex 1 | C Ex 2 | C Ex 3 | C Ex 4 | C Ex 5 | C Ex 6 | C Ex 7 | C Ex 8 |
|---|---|---|---|---|---|---|---|---|
| Material of insulating layer | PEN | PEN | PEN | PEN | PEN | PEN | PEN | PEN |
| Melting point [° C.] | 265 | 265 | 265 | 265 | 265 | 265 | 265 | 265 |
| Glass transition temperature [° C.] | 155 | 155 | 155 | 155 | 155 | 155 | 155 | 155 |
| Dielectric constant of thermoplastic resin | 3.0 | 3.0 | 3.0 | 3.0 | 3.0 | 3.0 | 3.0 | 3.0 |
| Average bubble diameter [μm] | 7 | 7 | 7 | 11 | 25 | 31 | — | — |
| Foaming magnification | 1.7 | 2.1 | 2.8 | 2.5 | 1.9 | 1.8 | 1.0 (No foaming) | 1.0 (No foaming) |
| Thickness of foamed insulating layer [μm] | 139 | 140 | 146 | 143 | 133 | 133 | 100 | 0.14 |
| Thickness of outer skin layer [μm] | 9 | 5 | 5 | 3 | 8 | 6 | — | — |
| Thickness of inner skin layer [μm] | ≤1 | ≤1 | ≤1 | ≤1 | ≤1 | ≤1 | — | — |
| (Total thickness of inner and outer skin layers)/ (Total thickness of inner and outer skin layers and foamed insulating layer) [%] | 6.1-6.7 | 3.4-4.1 | 3.3-3.9 | 2.1-2.7 | 5.7-6.3 | 4.3-5.0 | — | — |
| Dielectric breakdown voltage [kV] | 12.8 | 12.0 | 12.2 | 10.5 | 9.5 | 9.0 | 17.4 | 21.4 |
| Effective dielectric constant of foamed insulating layer | 2.3 | 1.9 | 1.8 | 1.8 | 2.1 | 2.2 | 3.0 | 3.0 |
| Partial discharge inception voltage [V] | 1700 | 1600 | 1700 | 1650 | 1500 | 1450 | 1100 | 1300 |

"C Ex" means Comparative Example.

As shown in Table 1-1 and Table 1-2, the dielectric breakdown voltage could be maintained finely and decrease in the effective dielectric constant and improvement of PDIV due to foaming were observed in Examples 1 to 8. On the other hand, although decrease in the effective dielectric constant and improvement of PDIV were observed, the dielectric breakdown voltage was decreased in Comparative Examples 1 to 6. In Comparative Examples 1 to 6, the cases where the dielectric breakdown voltage was lower than 80% with respect to that determined in Comparative Examples 7 and 8, in which the foaming was not conducted, were considered as decreasing.

TABLE 2

| | Ex 9 | Ex 10 | Ex 11 | C Ex 9 | C Ex 10 | C Ex 11 |
|---|---|---|---|---|---|---|
| Material of insulating layer | PPS | PPS | PPS | PPS | PPS | PPS |
| Melting point [° C.] | 280 | 280 | 280 | 280 | 280 | 280 |
| Glass transition temperature [° C.] | 90 | 90 | 90 | 90 | 90 | 90 |
| Dielectric constant of thermoplastic resin | 3.2 | 3.2 | 3.2 | 3.2 | 3.2 | 3.2 |
| Conductor diameter [mm] | 1 | 0.4 | 0.4 | 1 | 1 | 0.4 |
| Average bubble diameter [μm] | 1 | 3 | 2 | 8 | — | — |
| Foaming magnification | 1.5 | — | — | 1.4 | 1.0 (No foaming) | 1.0 (No foaming) |
| Thickness of foamed insulating layer [μm] | 40 | 35 | 36 | 40 | 30 | 40 |
| Thickness of outer skin layer [μm] | 4 | 5 | 5 | 3 | — | — |
| Thickness of inner skin layer [μm] | ≤1 | ≤1 | ≤1 | ≤1 | — | — |
| (Total thickness of inner and outer skin layers)/(Total thickness of inner and outer skin layers and foamed insulating layer) [%] | 9.1-11.1 | 12.5-14.6 | 12.2-14.3 | 7.0-9.1 | — | — |
| Dielectric breakdown voltage [kV] | 5 | 4.8 | 5.4 | 2.8 | 4.8 | 5 |
| Effective dielectric constant of foamed insulating layer | 2.4 | 2.5 | 2.5 | 2.3 | 3.2 | 3.2 |
| Partial discharge inception voltage [V] | 720 | — | — | 720 | 590 | — |

"Ex" means Example according to the present invention, and "C Ex" means Comparative Example.

As shown in Table 2, the dielectric breakdown voltage could be maintained finely and decrease in the effective dielectric constant and improvement of PDIV due to foaming were observed in Examples 9 to 11. On the other hand, although decrease in the effective dielectric constant and improvement of PDIV were observed, the dielectric breakdown voltage was decreased in Comparative Example 9. In Comparative Example 9, the case where the dielectric breakdown voltage was lower than 80% with respect to that determined in Comparative Examples 10 and 11, in which the foaming was not conducted, was considered as decreasing.

TABLE 3

| | Ex 12 | C Ex 12 | C Ex 13 |
|---|---|---|---|
| Material of insulating layer | PET | PET | PET |
| Melting point [° C.] | 260 | 260 | 260 |
| Glass transition temperature [° C.] | 70 | 70 | 70 |
| Dielectric constant of thermoplastic resin | 3.2 | 3.2 | 3.2 |
| Conductor diameter [mm] | 0.5 | 0.5 | 0.5 |
| Average bubble diameter [μm] | 2 | 10 | — |
| Foaming magnification | 1.6 | — | 1.0 (No foaming) |
| Thickness of foamed insulating layer [μm] | 39 | 43 | 32 |
| Thickness of outer skin layer [μm] | 4 | 12 | — |
| Thickness of inner skin layer [μm] | ≤1 | ≤1 | — |
| (Total thickness of inner and outer skin layers)/(Total thickness of inner and outer skin layers and foamed insulating layer) [%] | 9.3-11.4 | 21.8-23.2 | — |
| Dielectric breakdown voltage [kV] | 12.8 | 8.5 | 11.6 |
| Effective dielectric constant of foamed insulating layer | 2.2 | — | 3.2 |
| Partial discharge inception voltage [V] | 940 | — | 700 |

"Ex" means Example according to the present invention, and "C Ex" means Comparative Example.

As shown in Table 3, the dielectric breakdown voltage could be maintained finely and decrease in the effective dielectric constant and improvement of PDIV due to foaming were observed in Example 12. On the other hand, the dielectric breakdown voltage was decreased in Comparative Example 12. In Comparative Example 12, the case where the dielectric breakdown voltage was lower than 80% with respect to that determined in Comparative Example 13, in which the foaming was not conducted, was considered as decreasing.

The foamed electrical wire of the present invention has a cross-sectional surface for which cross-sectional views are shown in FIGS. 1 (*a*) and 1 (*b*) and FIGS. 2 (*a*) to 2 (*c*).

Examples 1 to 8 and 12 each has a cross-sectional surface without the inner skin layer 3 for which a cross-sectional view is shown in FIG. 2(*a*). Furthermore, since the inner skin layer 3 and outer skin layer 4 were disposed in Examples 9 to 11, the foamed electrical wires each has a cross-sectional surface for which a cross-sectional view is shown in FIG. 2(*c*).

The foamed electrical wire of the present invention can be applied to the case where the inner skin layer 3 and outer skin layer 4 are not used as shown in the cross-sectional view in FIG. 1 (*a*) and to the rectangular conductor 1 as shown in the cross-sectional view in FIG. 1 (*b*).

INDUSTRIAL APPLICABILITY

The present invention can be utilized in fields for which voltage resistance and heat resistance are required such as automobiles and various electrical and electronic instruments.

The present invention is not construed to be limited by the above-mentioned embodiments, and various modifications can be made within the scope of the technical matter of the present invention. Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2010-070068 filed in Japan on Mar. 25, 2010, which is entirely herein incorporated by reference.

REFERENCE SIGNS LIST

1 Conductor
2 Foamed insulating layer
3 Inner skin layer
4 Outer skin layer

The invention claimed is:

1. A foamed electrical wire, comprising:
a conductor; and
a foamed insulating layer;
wherein the foamed insulating layer comprises a resin, which is only one resin selected from the group consisting of polyphenylene sulfide, polyethylene naphthalate, polyether ether ketone and thermoplastic polyimide, and
wherein an average diameter of bubbles formed in the resin of the foamed insulating layer is 5 μm or less.

2. The foamed electrical wire according to claim 1, wherein the effective dielectric constant of the foamed insulating layer is 2.5 or less.

3. The foamed electrical wire according to claim 1, wherein the dielectric constant of the thermoplastic resin is 4.0 or less.

4. The foamed electrical wire according to claim 1, wherein the thickness of the foamed resin layer is from 30 to 200 μm.

5. The foamed electrical wire according to claim 1, wherein the average bubble diameter of the foamed insulating layer is from 0.1 to 5 μm.

6. The foamed electrical wire according to claim 1, further comprising a non-foamed outer skin layer outside of the foamed insulating layer,
wherein the thickness of the outer skin layer is 20% or less with respect to the total of the thickness of the outer skin layer and the thickness of the foamed insulating layer.

7. The foamed electrical wire according to claim 1, further comprising a non-foamed inner skin layer inside of the foamed insulating layer,
wherein the thickness of the inner skin layer is 20% or less with respect to the total of the thickness of the inner skin layer and the thickness of the foamed insulating layer.

8. The foamed electrical wire according to claim 1, further comprising:
a non-foamed outer skin layer outside of the foamed insulating layer; and
a non-foamed inner skin layer inside of the foamed insulating layer;
wherein the total of the thickness of the inner skin layer and the thickness of the outer skin layer is 20% or less with respect to the total of the thickness of the inner skin layer, the thickness of the outer skin layer and the thickness of the foamed insulating layer.

9. The foamed electrical wire according to claim 8,
wherein the thickness of the outer skin layer is 9 μm or less; and
wherein the thickness of the inner skin layer is 1 μm or less.

10. A method of producing a foamed electrical wire, comprising a step of:
coating a conductor with an insulating layer; and
foaming the insulating;
wherein the foamed insulating layer comprises a resin, which is only one resin selected from the group consisting of polyphenylene sulfide, polyethylene naphthalate, polyether ether ketone and thermoplastic polyimide, and
wherein an average diameter of bubbles formed in the resin of the foamed insulating layer is 5 μm or less.

11. The method of producing a foamed electrical wire according to claim 10, wherein the thickness of the foamed resin layer is from 30 to 200 μm.

12. The method of producing a foamed electrical wire according to claim 10, wherein the average bubble diameter of the foamed insulating layer is from 0.1 to 5 μm.

13. The method of producing a foamed electrical wire according to claim 10,
wherein a non-foamed outer skin layer is provided outside of the foamed insulating layer;
wherein a non-foamed inner skin layer is provided inside of the foamed insulating layer; and
wherein the total of the thickness of the inner skin layer and the thickness of the outer skin layer is 20% or less with respect to the total of the thickness of the inner skin layer, the thickness of the outer skin layer and the thickness of the foamed insulating layer.

14. The method of producing a foamed electrical wire according to claim 13, wherein the thickness of the outer skin layer is 9 μm or less; and
wherein the thickness of the inner skin layer is 1 μm or less.

* * * * *